United States Patent [19]

Papapavlou

[11] Patent Number: 4,773,651

[45] Date of Patent: Sep. 27, 1988

[54] WORD GAME AND BOARD

[76] Inventor: George Papapavlou, 12531 La Rochelle, Houston, Tex. 77015

[21] Appl. No.: 78,666

[22] Filed: Jul. 28, 1987

[51] Int. Cl.[4] ..... A63F 3/00

[52] U.S. Cl. ..... 273/249; 273/272; 273/299

[58] Field of Search ..... 273/249, 272, 299, 148 A, 273/248, 236

[56] References Cited

U.S. PATENT DOCUMENTS 1,282,149 10/1918 Trippe ..... 273/249
1,512,147 10/1924 Tegtmeyer et al. ..... 273/272
1,781,850 11/1930 Ladd ..... 273/148 A X
2,766,987 10/1956 Seelbrede et al. ..... 273/299 X
4,449,710 5/1984 Davis ..... 273/249

*Primary Examiner*—Anton O. Oechsle
*Attorney, Agent, or Firm*—Dowell & Dowell

[57] ABSTRACT

A hand of cards bearing letters of the alphabet and a combined scoring and word card are dealt to each player, the players drawing a card from the deck and discarding in turn until one player's letter cards spell the word of his word card, the player then placing the word card in a space adapted to receive it on a score board having graduated spaces for each of the players, and continuing the game until one player has filled the spaces provided for him on the score board.

8 Claims, 1 Drawing Sheet

WORD GAME AND BOARD

BACKGROUND OF THE INVENTION

1. Field of the Invention

This invention relates to games of the type played with cards to form words and having scoring objectives and scoring means.

2. Description of the Prior Art

Card games in which the cards have letters thereon for the purpose of spelling words have been known, as in the U.S. patents to Ford U.S. Pat. No. 1,107,417, Shinn U.S. Pat. No. 1,312,278, Kaufman U.S. Pat. No. 1,491,536 and Head U.S. Pat. No. 4,402,513.

Gameboards having spaces for game markers for scoring are disclosed in the U.S. patents to Post U.S. Pat. No. 2,549,708, Napoli U.S. Pat. No. 3,721,443, Stringer U.S. Pat. No. 4,095,799 and Voit U.S. Pat. No. Des. 135,465. All of the foregoing boards, except Stringer, disclose boards having peripheral portions for the players.

DESCRIPTION OF A PREFERRED EMBODIMENT

Figure 1:
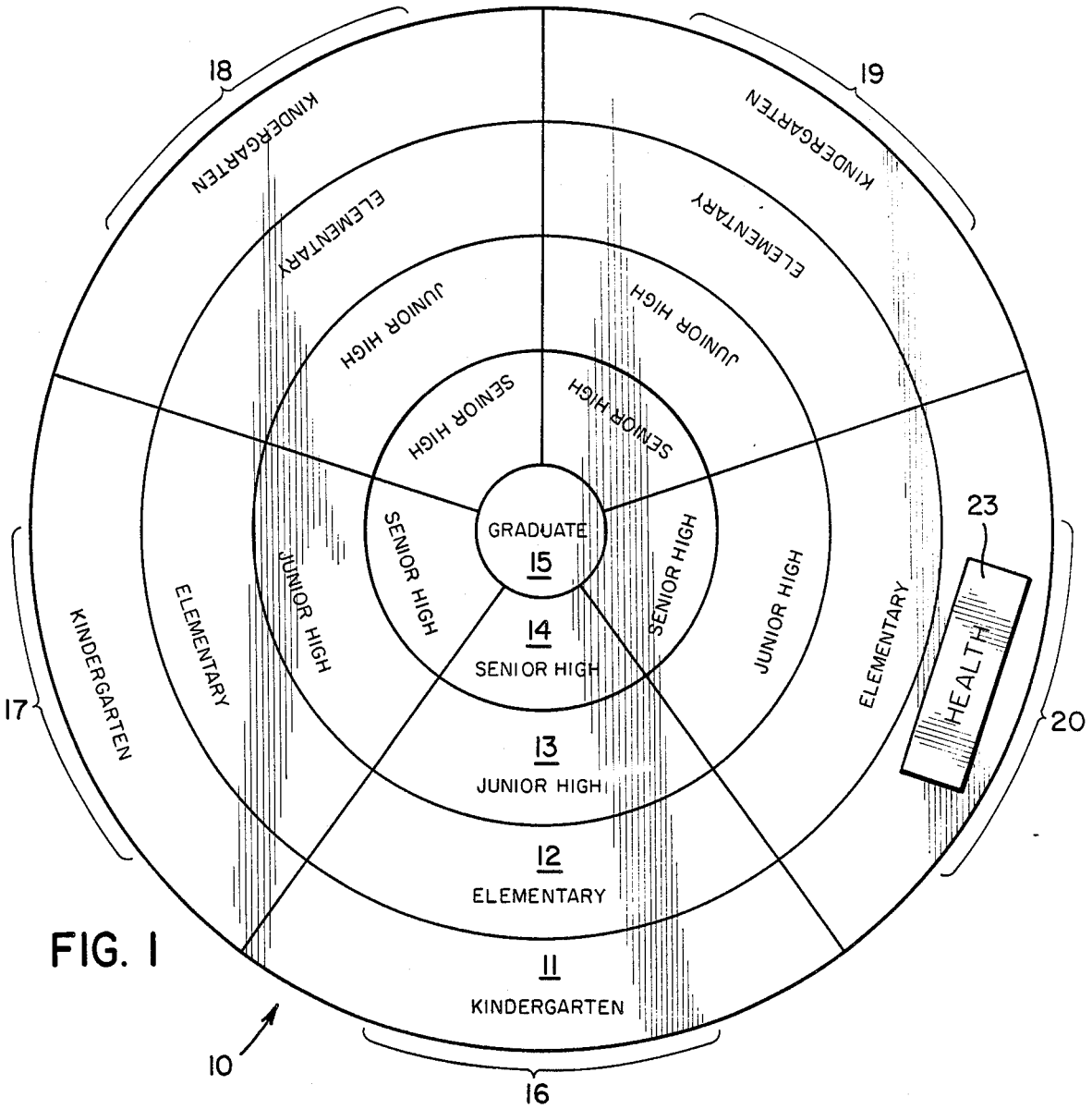
FIG. 1 is a layout of a gameboard in accordance with the present invention.

With further reference to the drawing, a gameboard 10 is provided for purposes of permitting each player to indicate his score and his progress towards the objective. In the illustrated embodiment, the board is divided into a plurality of ring-like spaces 11–14 terminating in inner circle 15. The spaces have indicia such as words indicating progress through school arranged in peripheral portions 16–20. A representative arrangement of words is KINDERGARTEN, ELEMENTARY, JUNIOR HIGH, SENIOR HIGH and GRADUATE.

Figure 2:
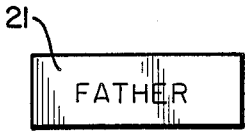
FIGS. 2 and 3 represent typical word cards.
Figure 3:
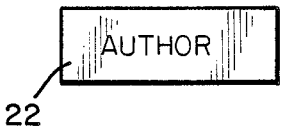

FIGS. 2 and 3 are representative of typical word cards 21 and 22. These cards have different words thereon, with a convenient length of six letters, each, although other length words may be used. To facilitate their use as scoring markers, the cards 21, 22 are preferably of a shape and size to fit within one of the ring-like spaces 11–14, as indicated by the card 23 represented in FIG. 1.

Figure 4:
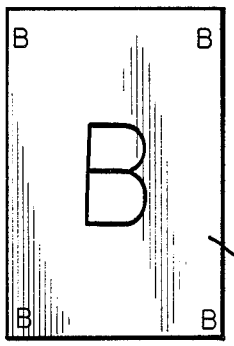
FIG. 4 represents a typical playing card.
Figure 5:
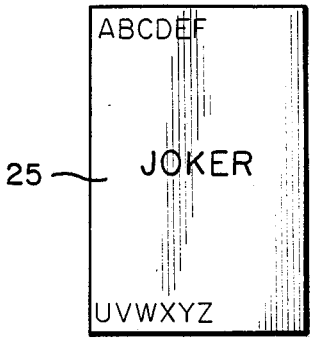
FIG. 5 represents a typical wild card.

In order for the players to play the game, a deck of cards bearing letters is provided. A typical letter bearing card 24 is indicated in FIG. 4 and a wild letter card or "joker" 25 is indicated in FIG. 5, such card being useable for any letter.

For purposes of convenient play for up to five players, the deck of cards bearing letters may number one hundred four and four wild cards.

At the commencement of play, each player is dealt a hand of six letter cards which may include one or more wild cards and one word card, all of which he conceals from the other players. Each player in turn attempts to spell with his letter cards the word on his word card, by, if necessary drawing a card from the remainder of the deck and discarding a card. The next player may pick up the top discarded card or draw from the deck, and discarda card. When a player has spelled the word on his word card, he announces this and places his word card in the outer ring-like space of his peripheral portion. The cards are then reshuffled and a new hand dealt to the players with a new word card. Play then resumes as before until the first player reaches the objective or GRADUATE level of the gameboard.

I claim:

1. A game comprising a deck of letter cards, a plurality of word cards, and a scoring board, said scoring board having a plurality of peripheral portions, one for each player, and a plurality of steps in series extending across the board for each peripheral portion, said steps being configured to accommodate said word cards, the game being so constructed and arranged that each of the players may receive a hand of letter cards from the deck and a word card and may attempt to form the word on his word card from the letter cards in his hand, the players drawing and discarding letter cards in turn until one player completes the word on his word card, such player then placing such word card on a first of the player's series of steps, the players then receiving a second hand of letter cards and a second word card, and continuing play, seriatim, until one player has placed a word card on each of the steps of his portion of the board.

2. The invention of claim 1, in which the deck and letter cards include at least one wild card.

3. The invention of claim 1, in which the deck has one hundred and four cards with letters and four wild cards.

4. The invention of claim 1, in which the scoring board peripheral portions are arranged in a ring-like configuration, and in which the steps are formed by inner rings of a width adapted to receive a word card.

5. The invention of claim 4, in which the rings are circular, and in which the innermost ring is a circle.

6. The invention of claim 1, in which each word card has a six letter word thereon.

7. The invention of claim 1, in which the steps of each peripheral portion, beginning at the outer portion, are indicated as KINDERGARTEN, ELEMENTARY, JUNIOR HIGH, SENIOR HIGH and GRADUATE, seriatim.

8. The method of playing a game, comprising dealing a hand of letter cards to a plurality of players, dealing a different word card to each player, the number of letter cards dealt corresponding to the number of letters on the word card, and the players drawing from the deck and discarding a card in turn until one player has letter cards which correspond to the word on his word card, and providing a scoring medium having a plurality of steps for each player, the steps being configured to accomodate each player's word card, the one player having letter cards corresponding to the word on his word card then placing his word card on a step of the scoring medium.

* * * * *